US006048355A

United States Patent [19]

Mann et al.

[11] Patent Number: 6,048,355

[45] Date of Patent: Apr. 11, 2000

[54] EAR PIERCING CARTRIDGES

[75] Inventors: Samuel J. Mann, Englewood; Charles Kowalski, Ridgewood, both of N.J.

[73] Assignee: Cookson Group PLC, United Kingdom

[21] Appl. No.: 09/288,907

[22] Filed: Apr. 9, 1999

[51] Int. Cl.[7] ..... A61B 17/34

[52] U.S. Cl. ..... 606/188; 606/181

[58] Field of Search ..... 606/188, 181, 606/185, 117

[56] References Cited

U.S. PATENT DOCUMENTS

| | | | |
|---|---|---|---|
| 3,943,935 | 3/1976 | Cameron . | |
| 4,020,848 | 5/1977 | DiCicco | 606/188 |
| 4,030,507 | 6/1977 | Mann . | |
| 4,527,563 | 7/1985 | Reil | 606/188 |
| 4,931,060 | 6/1990 | Aue . | |
| 5,004,470 | 4/1991 | Mann . | |
| 5,004,471 | 4/1991 | Mann . | |
| 5,007,918 | 4/1991 | Mann . | |
| 5,263,960 | 11/1993 | Mann . | |
| 5,350,394 | 9/1994 | Mann . | |
| 5,360,434 | 11/1994 | Mann . | |
| 5,441,514 | 8/1995 | Durham . | |
| 5,496,343 | 3/1996 | Reil . | |
| 5,499,993 | 3/1996 | Blomdahl et al. . | |
| 5,690,665 | 11/1997 | Mann . | |
| 5,925,057 | 7/1999 | Blomdahl . | |

*Primary Examiner*—Michael Buiz
*Assistant Examiner*—Kevin Truong
*Attorney, Agent, or Firm*—Weingram & Associates, P.C.

[57] ABSTRACT

A disposable Ear Piercing device consists of an outer cartridge which is inserted into the piercing instrument. The outer cartridge contains a slideable inner capsule retaining an earring with a slideable spacer therein. By applying force to the instrument handle, an internal driving rod advances the inner capsule and slideable spacer forward, forcing the earring post through the ear and into a closed bottom retaining clutch. At such time, the earring is released from the inner capsule by spring arms which are integral with the spacer, opening hinged doors or door on the inner capsule, clearing the outer cartridge and allowing the earring and clutch to be released from the capsule onto the ear. The design of such inner capsule and spacer allows unsymmetrical decorative heads of varying thickness to be utilized.

23 Claims, 7 Drawing Sheets

EAR PIERCING CARTRIDGES

BACKGROUND OF THE INVENTION

1. Field of the Invention

The present invention relates to a unique ear piercing system that is capable of inserting odd shaped decorative headed earrings of various thickness and shapes into a disposable cartridge.

Ear piercing devices in existence are either stud piercers which are usually made with a smaller diameter pointed end and with an increased diameter shaft beyond the pointed end which resides within the earlobe after insertion. The stud ear piercing earring is usually fabricated from a solid shaped material and machined to create the stepped shaft diameters limiting the shape of the decorative stud head. Stud earrings are also restricted to specific head diameters as to be retained in the piercing instrument. Such instruments contain a series of interchangeable adapters to accommodate the head of such studs, creating a limited selection of styles and increased difficulty in preparing the piercing instrument to accept the stud.

The alternate ear piercer usually consists of a smaller diameter straight shaft post of uniform diameter containing a locking undercut portion that engages a clutch to which post a decorative head is attached.

A number of piercing devices in use employ an outer cartridge and slideable inner capsule, on occasion containing a spacing shim within to accommodate the irregular shaped earring head. This construction requires the inner capsule to be of such design as to allow the decorative head of the earring to open the inner capsule after such earring has been inserted into the ear. The geometry of the decorative head is severely limited as in the stud design of earring. Examples of such ear piercing devices are described in the following patents.

Description of the Related Art

U.S. Pat. No. 3,943,935 to Cameron discloses a disposable earlobe piercing apparatus having a movable anvil and spring biased carriage operable to trigger a piercing dart. Movement of a spring housing and barrel on the carriage releases the dart to pierce the earlobe and engage a catch on the anvil. A catch spring holds the dart shaft and permits removal of the apparatus.

U.S. Pat. No. 4,030,507 to Mann discloses a sterile earlobe piercing assembly including a piercing earring having an enlarged portion and piercing pin and cartridge to receive the earring. The cartridge includes a first opening supporting the pin and a second opening aligned with the first. A plunger including an earlobe support enters the second opening, contacts the piercing earring and forces the enlarged portion of the earring through the first opening. The piercing earring is symmetrically shaped around the axis of the pin.

U.S. Pat. No. 5,004,470 to Mann concerns a simplified disposable ear piercing cartridge assembly for protecting the ear piercing gun and customer from contamination. A stud cartridge releasably contains a pair of earring studs. A clutch cartridge releasably contains a pair of earring clutches. A spring gun ejects the earring stud to pierce the ear and engage the clutch. The spring gun selectively receives and positions the stud cartridge and clutch cartridge for piercing. The clutch cartridge is positioned between the ear and an anvil of the spring gun and the stud cartridge is positioned between the ear and spring gun.

U.S. Pat. No. 5,004,471 to Mann concerns a sterile ear piercing assembly for earrings having an enlarged abstractly shaped head portion. A cartridge receiving the earring includes two clamping arms and a rear portion having side and rear walls enclosing the earring. A housing for the cartridge holds it in a stored position which is movable. The housing includes camming surfaces engaging the clamping arms when the cartridge is displaced. The camming surfaces displace the clamping arms to release the piercing earring from the cartridge.

U.S. Pat. No. 5,007,918 to Mann relates to a sterile earlobe piercing cartridge having a piercing earring and pin and an ornamental head with a larger diameter than a push rod. A cartridge for the earring includes an elongated opening supporting the piercing pin and another opening proximate the ornamental head and aligned with the first opening and having a larger lateral dimension than the first opening. A shield fits within the cartridge between the head and the second opening and distributes pressure across the head from a push rod which enters the second opening to provide smooth low effort ear piercing with accurate axial alignment with concentric or non-concentric ornaments.

U.S. Pat. No. 5,263,960 to Mann relates to an integrated disposable ear piercing earring and clutch cartridge assembly including first and second ear piercing earrings and retaining sub-assembly for releasably supporting the earring. A clutch retaining sub-assembly is integral with the earring sub-assembly and releasably supports first and second clutches. An ear piercing instrument receives the cartridge assembly and includes a plunger for ejecting an earring from its sub-assembly and is selectively movable between a first position for ejecting the first earring from the retaining sub-assembly and a second position for ejecting the second earring from the retaining sub-assembly.

U.S. Pat. No. 5,350,394 to Mann discloses an ear piercing earring cartridge assembly including an ear piercing earring, a retaining sub-assembly for releasably supporting the earring, a clutch and retaining sub-assembly releasably supporting the clutch, a floor between the two sub-assemblies forming a saddle region, clamp means movable from a first to a second position for clamping an earlobe within the saddle region against the clutch sub-assembly when the clamp is in the second position, and earlobe thickness adjusting means for adjusting the clamp position to accommodate a variety of earlobe thicknesses.

U.S. Pat. No. 5,496,343 to Reil discloses a hand held disposable ear piercer using the gripping force of a hand to drive the earring post through the ear into an earring nut. Opposing jaws hold the earring and nut with the earlobe therebetween. A frangible tab must be broken by sufficient force of the hand squeeze to accelerate the jaws together and pierce the earlobe. Insertion of the nut jaw into the earring jaw causes a flexible tang to catch the back side of the earring cartridge to expel it when the nut jaw is withdrawn from the earring jaw. A top gap in the earring jaw above the earring cartridge permits use of ornamented earrings with hoops or other extensions.

While many variations of ear piercing devices are known, these have generally been quite complex, difficult to use, subject to contamination and limited in the type and design of the decorative earring that can be employed.

OBJECTS AND SUMMARY OF THE INVENTION

It is therefore the primary object of the present invention to provide an ear piercing device which permits use of a variety of decorative earring head styles and a variety of clutches.

It is another object of the invention to provide an ear piercing device employing a sterile disposable cartridge.

It is a further object of the invention to provide a simplified ear piercing device which reduces the necessary handling of the various components.

It is a still further object of the invention to provide an ear piercing device which can be used with symmetrical and nonsymmetrical decorative earring heads of varying sizes and thicknesses.

It is an additional object of the invention to provide an ear piercing device having a cartridge which is ejectable following the completion of the ear piercing.

Yet another object of the invention is to provide an ear piercing device which provides a safe secure connection between earring head and clutch.

A still further object of the invention is to provide an ear piercing device that reliably and accurately positions the earrings.

Another object of the invention is to provide an ear piercing device which is inexpensive, durable and easily stored without.

There is a further object of the invention to provide an ear piercing device that can be used with non-symmetrical earring heads without distorting the head of the earring during the insertion of the earring in the ear.

It is also an object of the invention to provide a unique disposable cartridge containing an inner slideable capsule carrying the decorative earring head and post and a slideable spacer within the capsule which in conjunction with capsule projects the earring head and post through the earlobe into the clutch held in the cartridge at an opposing position.

An added object of the invention is to provide a release mechanism on the slideable capsule and spacer to permit removal of the earlobe and fastened earring from the disposable cartridge.

Still another object of the present invention is to provide an ear piercing device which enables easy removal of the earlobe after insertion of the earring and minimizes any catching of the earlobe in the ear piercing device.

These objects are achieved with a novel ear piercing device including a disposable sterile cartridge which is inserted into the ear piercing instrument. The cartridge includes a cylindrical passage at one end for receiving a slidable capsule carrying the decorative earring head and post and a slideable spacer within the capsule. A trigger controlled by the handle of the instrument activates the slideable spacer in conjunction with the capsule and projects the earring head and post through the earlobe positioned in an open saddle region in the cartridge. A clutch held at the opposing side of the saddle region at the other end of the cartridge receives and engages the earring post. A release mechanism on the slideable capsule and spacer permits removal of the earlobe and earring from the disposable cartridge which is ejected from the instrument. The unique design of the inner capsule and spacer permits use of decorative earring heads of unsymmetrical shapes and sizes.

Other objects and advantages will become apparent from the following description in conjunction with the accompanying drawings.

BRIEF DESCRIPTION OF THE DRAWINGS

For a more complete understanding of the present invention, reference may be had to the following description of exemplary embodiments of the present invention considered in connection with the accompanying drawings, in which.

DESCRIPTION OF THE PREFERRED EMBODIMENTS

Figure 1:
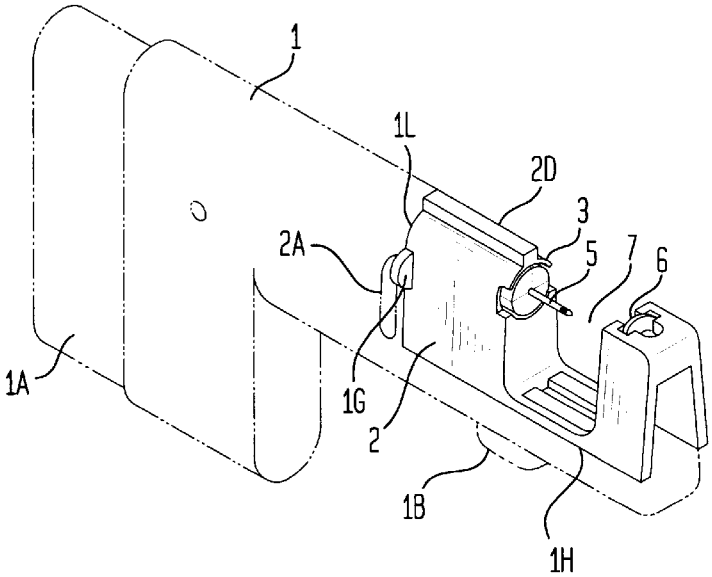
FIG. 1 is a generalized view of the instrument body shown in dashed lines with the present cartridge in position prior to piercing the ear.
Figure 4:
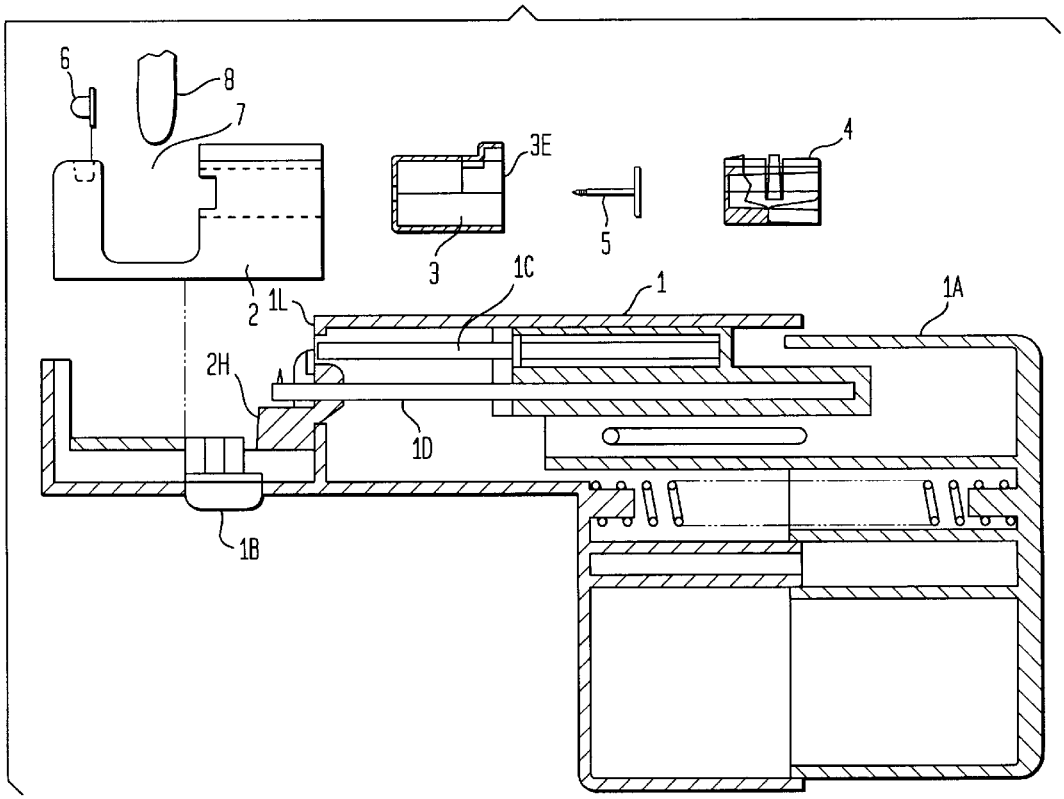
FIG. 4 is a side section of the piercing instrument showing the relationship of the outer cartridge, inner capsule, spacer, earring and clutch.

As shown in FIG. 1, the present invention includes an outer cartridge and instrument for piercing an earlobe and inserting an earring. The instrument as generally described in U.S. Pat. No. 5,360,434, provides a platform for such invention, but use is not limited to this instrument. The instrument is manually operated by applying force to the extended handle 1A that is spring biased outwardly in the rest position, as shown in FIG. 4. The handle encloses an inner structure with a push rod 1C and spring cushioned extractor shaft 1D containing extension 1E, as more clearly shown in FIG. 7. Such structure is operated to move the push rod 1C and extractor shaft 1D forward.

The piercing process commences with the insertion of outer cartridge 2 into the instrument as shown in FIG. 1. The outer cartridge is retained by channel 1G integral with the main body of the instrument. Retaining ears 2A, shown in FIG. 2, extend from the side walls of the cartridge and when the cartridge is inserted onto the instrument, it is retained from moving forward and upward. Cartridge 2 is provided with inner retainers 2B engaging the platform 1H of the instrument.

Figure 2:
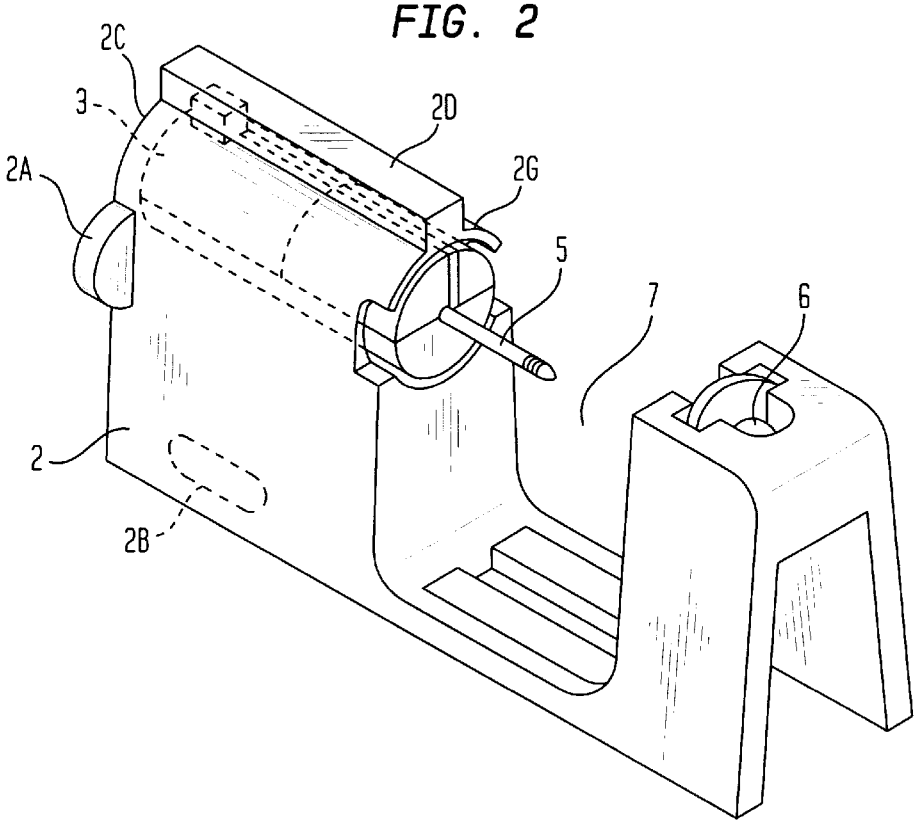
FIG. 2 is an enlarged view of the outer cartridge containing the inner capsule.
Figure 3:
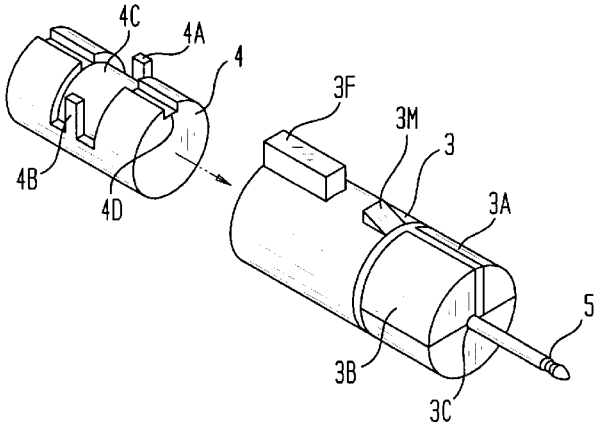
FIG. 3 is a view of the inner capsule into which the slideable spacer is to be inserted.

Inner capsule 3, illustrated in FIGS. 2 and 3, contains the earring 5 with a post or pin and the internal spacer 4 in position to align the earring post horizontally without movement. FIG. 4 illustrates the positioning of the cartridge and instruments internal elements. The spacer 4 is inserted so its front face is in contact with the decorative head of the earring. Such position is maintained by friction provided by the spring arms 4A and 4B shown in FIG. 3.

Figure 7:
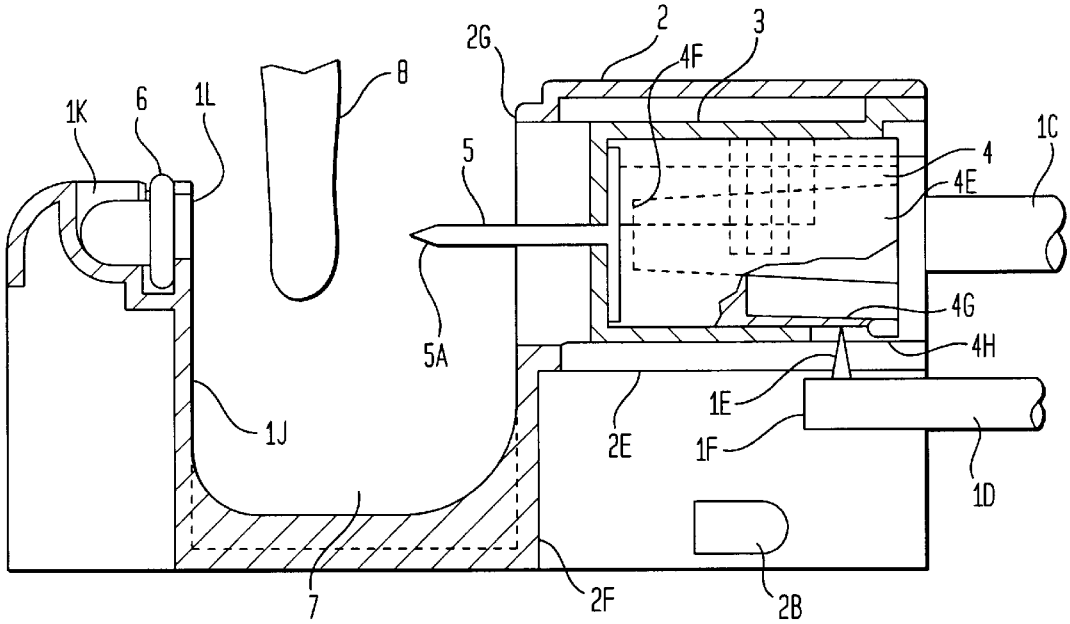
FIG. 7 is an enlarged sectional view of the assembled cartridge prior to insertion of the earring into the ear.

The earring post retainer is traditionally referred to as a clutch 6, located in the end wall 1J shown in FIG. 7, forming a saddle region 7 into which the earlobe 8 will reside during the piercing operation. Clutch 6 is of a closed end construction retained in the well 1K of the end wall by a retaining rib or viscous film or adhesive allowing it to be handled without falling out during the cartridge insertion onto the instrument and in transit. Alternate styled clutches are useable only requiring a conformal pocket, seen in FIG. 7.

Figure 8:
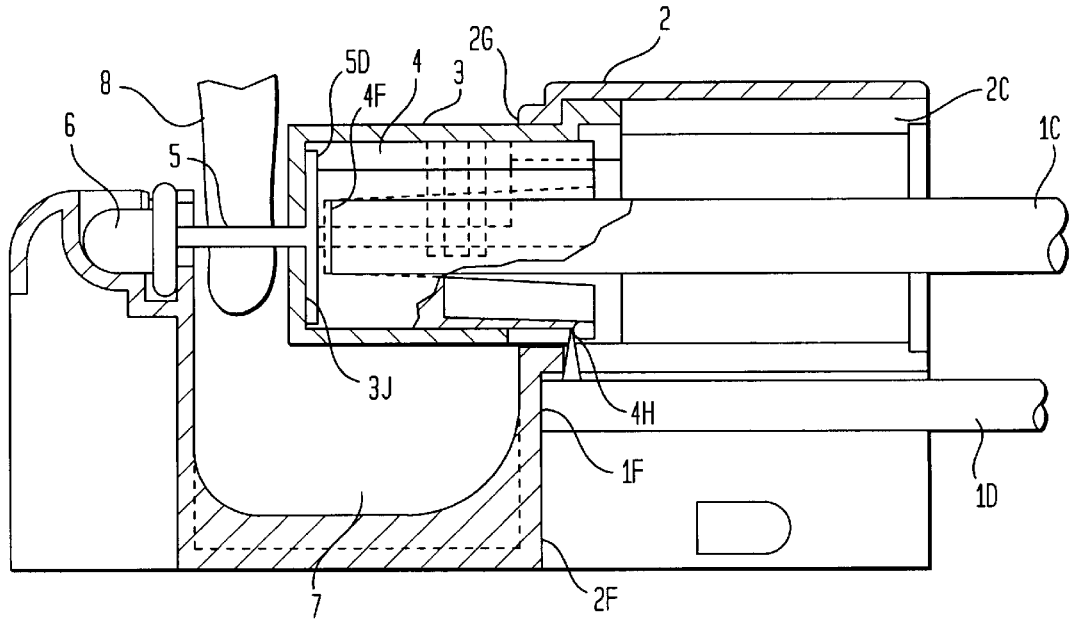
FIG. 8 is an enlarged sectional view of the cartridge position after piercing the earlobe.

In the ear piercing process the extractor shaft 1D moves in a forward direction and, being ahead of the push rod 1C will begin to move the capsule 3 towards the ear 8. The push rod 1C will enter into the inner spacer 4 and advance the capsule assembly as shown in FIG. 8. The point on the earring post or shaft 5 will penetrate the ear 8, enter into the clutch 6 and at a specific point the doors 3A and 3B shown in FIGS. 3, 5 and 9A, will rotate to open outwardly allowing the piercing instrument to be lowered away from the ear to release the earring and clutch, completing the sequence. The disposable cartridge 2 is then removed from the instrument by pressing on the ejector button 1B located on the underside of the instrument and discarded.

As further shown in FIGS. 2 and 8, the cartridge 2 is provided with bore 2C of a larger diameter. The top portion of the cartridge consists of a raised hood 2D that provides alignment and prevents rotation of raised rib 3F on inner capsule 3, shown in FIG. 3. Rib 3F is slideable within raised hood 2D. The cartridge need not be a cylinder but may be shaped with a square, rectangular or irregular opening to accommodate an inner capsule of like profile.

Figure 5:
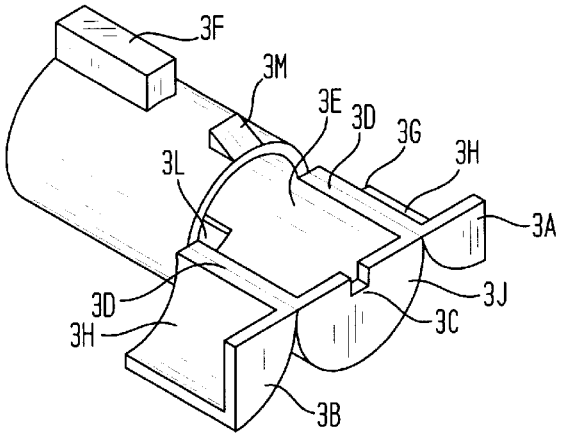
FIG. 5 is a view of the inner capsule open prior to assembly.

Referring to FIGS. 3 and 5, the assembly of the cartridge commences with the application of earring and post 5 into the square U channel 3C. Covers or doors 3A and 3B are attached to the inner capsule 3 by flexible hinges 3D located on the sides of the capsule and commonly referred to as a living hinge. The inner capsule 3 is fabricated of a plastic or flexible material which may have a spring memory. The covers 3A and 3B are then folded onto the spacer creating a closed tube structure and, when inserted into the cartridge 2, aligning the rib 3F, with the hood 2D, FIG. 2, and retaining the earring post.

Cover 3B being wider than cover 3A overlaps channel 3C in order to apply a retaining and alignment force to the earring post shown in FIG. 3.

Figure 5A:
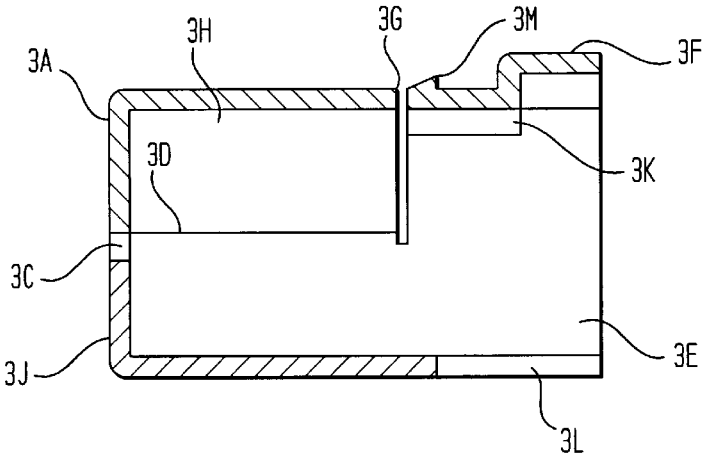
FIG. 5A is an enlarged sectional view of the interior of the inner capsule.
Figure 6:
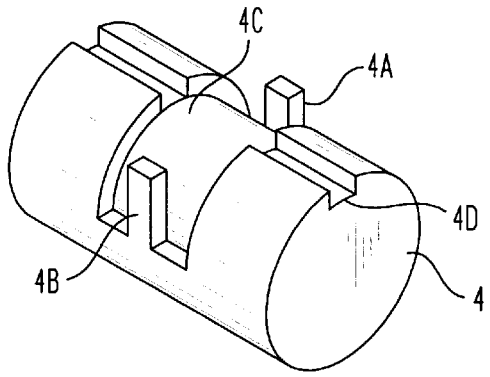
FIG. 6 is a view of the spacer with foldable arms to be inserted into the inner capsule.

The spacer 4 is provided with symmetrical arms 4A and 4B which are molded integral with the structure 4. The arms are folded down onto the cylinder provided with clearance 4C creating a uniform diameter of such size to fit into the opening 3E of the inner capsule shown in FIG. 4. Spacer 4 is provided with an alignment channel 4D located between arms 4A and 4B, as in FIGS. 3 and 6. The alignment channel 4D extends along the length of the spacer. The inner capsule 3 is provided with a rib 3K, shown in FIG. 5A, on its internal diameter to align with channel 4D of spacer 4.

The spacer 4 with spring arms 4A and 4B now being biased is inserted into the inner capsule rear opening 3E. The assembly sequence is shown in FIG. 4. Spacer 4 is fabricated of a plastic or flexible material with a spring memory, or may be molded of a material which does not possess such properties but used in conjunction with a secondary spring mechanism, either metal or a springable plastic.

Figure 5B:
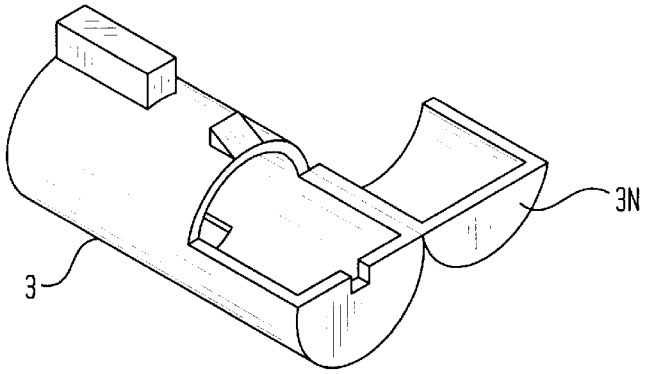
FIG. 5B is a view of the inner capsule with a single door prior to assembly.
Figure 6A:
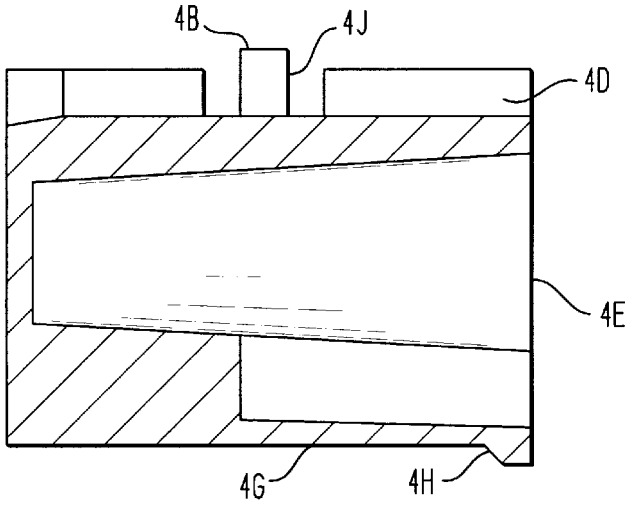
FIG. 6A is an enlarged sectional view of the spacer showing the ramp.
Figure 6B:
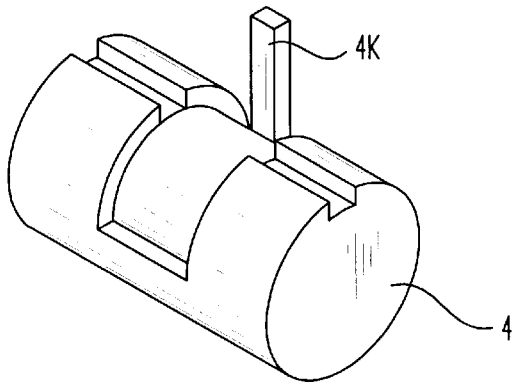
FIG. 6B is a view of the spacer with a single foldable arm to be inserted into the inner single door capsule.

FIGS. 5B and 6B are further embodiments of the inner capsule with a single foldable cover and the slideable spacer with a single spring arm for opening the single hinged cover.

FIG. 7 illustrates a partial sectional view of the instrument and cartridge with components in the initial piercing position. The push rod 1C and extractor shaft 1D are common to the moveable handle 1A, FIG. 4, which is in the outmost position to allow the cartridge 2 to be inserted onto the instrument and retained in position by raised protrusions 2B located on the inner walls of the cartridge, interfering with locks 1H on the instrument deck. With the instrument positioned in relation to the ear 8, the piercer operator moves the handle 1A with shafts 1C and 1D attached. The cartridge 2 includes a slot 2E receiving an extension 1E of shaft 1D. Inner capsule 3 is also provided with a similar slot 3L, FIG. 5A, into which the extension 1E must also pass. The shaft 1D extends beyond the wall 1L of the instrument and moves the inner capsule 3 towards the ear, at which time the push rod 1C enters into the rear wall bore 4E. As the handle 1A is being depressed, the point 5A of the earring post 5 will enter into the earlobe at the selected position. The position of earlobe 8 within the saddle region 7 of the cartridge allows flexibility in establishing the location of the piercing.

As shown in FIG. 8, shaft 1D advances towards the ear and being spring biased will be stopped at inner wall 2F with the end 1F of shaft 1D contacting the wall. The push rod 1C contacting the internal wall 4F acts upon the slideable spacer 4 forcing its engagement with the decorative head 5D of the earring causing the post to pass through the earlobe.

Figure 10:
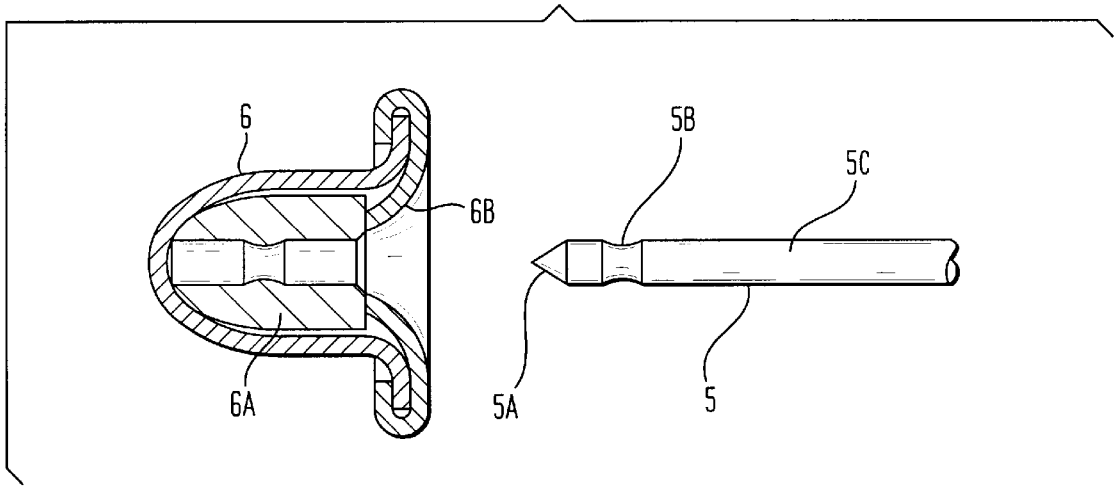
FIG. 10 is a sectional view of the clutch showing its internal elements.

The earring point 5A will then pass through retainer channel or well 1K, FIG. 7, whose purpose is to provide retention of the clutch 6 and into the opening 6B of the clutch. The clutch 6 includes an internal retention device 6A shown in FIG. 10, to grasp onto the shaft 5C of the earring. The shaft includes an undercut dimension 5B allowing the mechanical attachment of retainer 6A onto the shaft.

When the inner capsule 3 containing spacer 4 and earring 5 is fully extended by push rod 1C, the clutch 6 is now firmly attached to the earring 5 through and behind the earlobe 8 and the earring is released. Spring biased doors 3A and 3B are projected past wall 2G of the cartridge, FIG. 7, clearance being provided between cartridge wall 2G and ends 3G of the doors, FIG. 5. The spring fingers 4A and 4B which were compressed will be free to move into the unloaded location providing a force against the inside walls 3H of the inner cartridge. The doors now being thrust outward by virtue of being clear of surface 2G provide an open channel in the inner capsule, FIG. 9A. Doors 3A and 3B need not be retained by hinges 3D but may become separated and fall away from the inner capsule when the ear piercing has been completed.

To provide clearance between the surface of the ear and the end of the inner capsule 3J when the piercing has been completed, the slideable spacer 4 includes an integral flexible ramp 4G and projection 4H shown in FIG. 6A and FIG. 7.

Upon releasing pressure on the instrument handle 1A, the push rod 1C and extractor shaft 1D containing projection 1E will return back into the body 1 of the instrument. The projection 1E will bear against ramp projection 4H forcing the slideable spacer 4 back into the inner capsule 3. At this point the surfaces 4J of spring arms 4A and 4B, FIG. 6A, will come in contact with capsule wall 2G. This removes the holding pressure exerted on the decorative head 5D of the earring and the inside wall 3J of the inner cartridge, FIG. 9A. The ramp being cantilevered permits shaft extension 1E to retract back to its initial position.

The capsule 3 is additionally restricted from returning back into the cartridge 2 by the engagement of unidirectional ramp 3M located atop the capsules upper section, shown in FIGS. 3, 5, 5A, 9 and 9A. The ramp 3M being tapered in the forward position will be driven out from the cartridge bore 2C past the cartridge surface 2G at which point ramp 3M will abut surface 2G locking it into position and preventing the return of capsule 3 back into cartridge 2. The retention of the capsule 3 insures the engagement of the earring 5 into the clutch 6 as the earring decorative head 5D will not be pulled away from the clutch 6.

Figure 11:
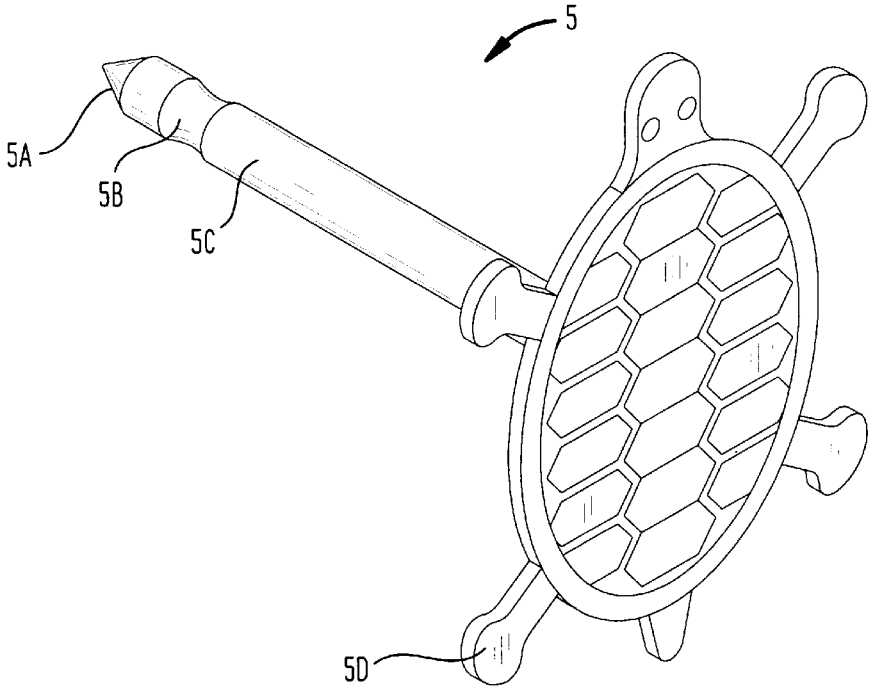
FIG. 11 is a view of a typical earring for use with the invention.

A typical irregular decorative earring is shown in FIG. 11, having the shape of a turtle for example.

Figure 9:
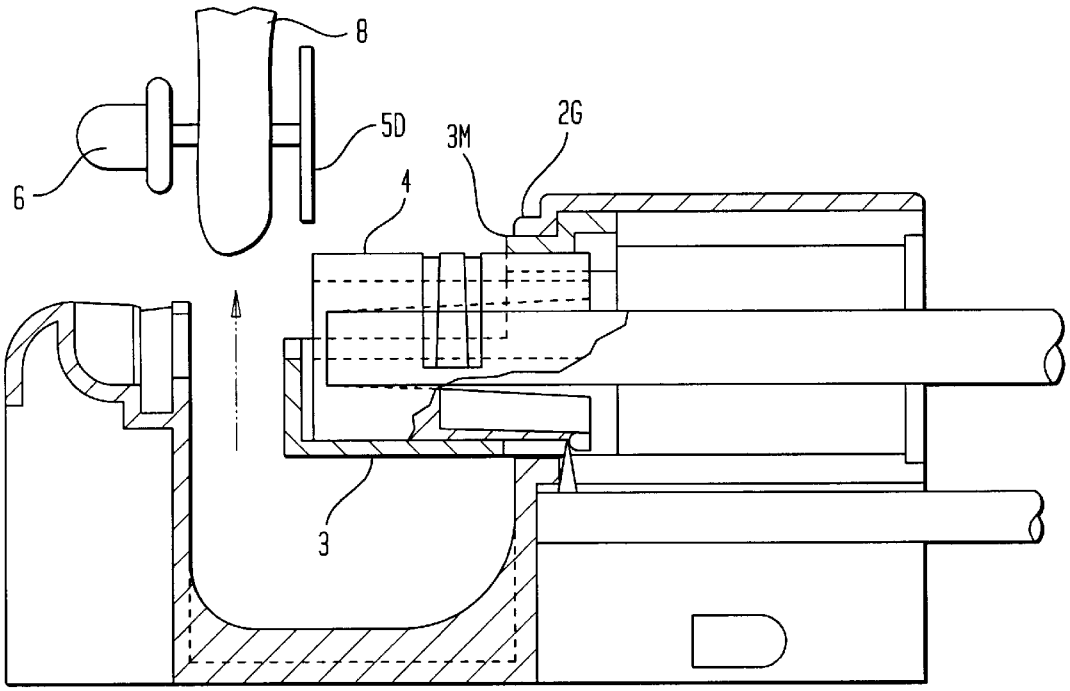
FIG. 9 is an enlarged sectional view of the cartridge removed from the ear.
Figure 9A:
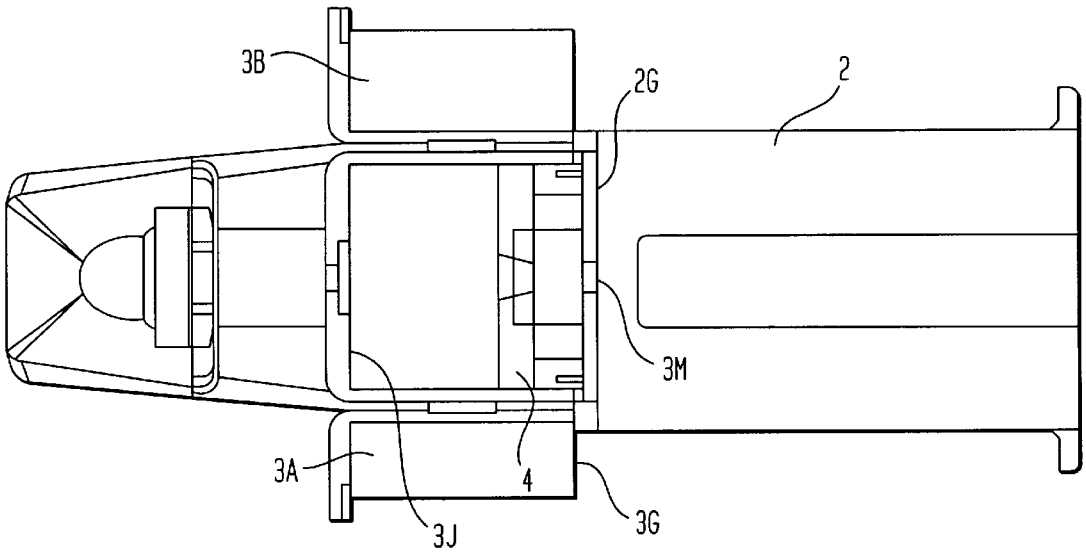
FIG. 9A is an enlarged plan view of the capsule with doors in the open position.

The piercer operator now only needs to lower the piercing instrument down and away from the ear allowing the earring with clutch attached to be free of the instrument, FIG. 9. The entire spent cartridge is now ejected from the instrument by applying force to the ejector button 1B, FIG. 4, located on the underside of instrument housing.

While only a limited number of embodiments have been illustrated and described, other variations may be made in the particular design and configuration without departing from the scope of the invention as set forth in the appended claims.

It will be understood that the embodiments described herein are merely exemplary and that a person skilled in the art may make many variations and modifications without departing from the spirit and scope of the invention. All such modification and variations are intended to be included within the scope of the invention as defined in the appended claims.

What is claimed is:

1. An earlobe piercing device comprising:

a manually operable instrument having a spring biased handle extending outwardly in a rest position, a push rod and a spring cushioned extractor shaft disposed in an upper portion of said handle and movable therewith, an open channel at one end of said instrument, a cartridge receivable in said open channel, said cartridge having a longitudinal passage at one end and a supporting wall at an opposed end, said supporting wall having a retainer channel for holding an earring clutch, said retainer channel being aligned with and spaced from said longitudinal passage, said cartridge including an open area between said one end of said cartridge and said supporting wall for receiving an earlobe and a longitudinal slot in a lower portion of said longitudinal passage, a tubular capsule slidable within said longitudinal passage and having an end wall and side walls extendable into said open area toward said supporting wall from a stationary retracted position, said end wall having a slot for receiving an earring post and supporting an earring head adjacent the inner side of said end wall, a lower wall of said capsule having a longitudinal slot, an inner spacer slidable within said tubular capsule and extendable therewith into said open area, said inner spacer having a longitudinal passage at one end, means for guiding said inner spacer along a straight path within said tubular capsule toward said end wall, means for guiding said tubular capsule along a straight path within said cartridge longitudinal passage, said push rod being receivable within said inner spacer longitudinal passage, and said extractor shaft being engageable with said longitudinal slot in said capsule lower wall, contraction of said handle causing forward movement of said extractor shaft to move said tubular capsule and movement of said push rod within said inner spacer moving said spacer into engagement with said earring head and end wall of said tubular capsule and causing said tubular capsule and earring post to extend into said open area to cause said post to pierce said earlobe and engage said earring clutch, means for limiting retraction of said tubular capsule and for preventing retraction of said post from said earring clutch, said extractor shaft including an extension passing through said longitudinal slot in said cartridge longitudinal passage and through said longitudinal slot in said lower wall of said capsule, means to release said cartridge from said instrument for disposal following completion of said earlobe piercing, said means for limiting retraction including:

a unidirectional ramp positioned on a peripheral surface of said tubular capsule spaced from said end wall, said ramp tapering downwardly and outwardly toward said end wall permitting outward movement of said tubular capsule to extend from said cartridge passage and having an upward wedged end preventing retraction into said cartridge passage, a pair of covers hinged along opposing diametrical side wall portions of said tubular capsule, said covers including end wall sections folding together over said end wall having said slot to form a complete end wall to enclose said earring post and earring head within said tubular capsule in a retracted position, said covers unfolding into an open position upon extension of said tubular capsule into said open area and limiting retraction of said tubular capsule, a pair of spring arms extending upwardly from opposing diametrical side wall portions of said inner spacer, said inner spacer having a clearance area between said side wall portions, said spring arms being foldable downwardly onto said clearance area and disposed within said tubular capsule in said retracted position, and said spring arms unfolding into an upward extending position upon extension of said tubular capsule and inner spacer into said open area and limiting retraction of said tubular capsule and inner spacer, said means for guiding said inner spacer within said tubular capsule includes an alignment channel along the upper surface of said inner spacer and a cooperating rib on the inner surface of said tubular capsule, said means for guiding said tubular capsule within said cartridge longitudinal passage includes a rib on the upper surface of said tubular capsule and a cooperating raised channel along the cartridge longitudinal passage, said inner spacer includes a flexible ramp and projection in a lower surface engageable with said tubular capsule slot and permitting partial retraction of said spacer within said tubular capsule, and said cartridge includes extending ears at opposing sides and inner retainers engageable with said instrument.

2. A device for use with an ear piercing instrument for securing earrings to an earlobe comprising:

a cartridge engageable with an ear piercing instrument, said cartridge having a longitudinal passage at one end and a supporting wall at an opposing end, said supporting wall having a retainer channel for holding an earring clutch, said channel being aligned with and spaced from said longitudinal passage, said cartridge including an open area between said one end and said supporting wall for receiving an earlobe, a tubular capsule slideable within said longitudinal passage and having an end wall and side walls extendable outwardly into said open area toward said supporting wall from a stationary retracted position, said end wall having a slot for receiving an earring post and supporting an earring head adjacent to the inner side of said end wall, an inner spacer slideable within said tubular capsule and extendable therewith into said open area, means for guiding said inner spacer along a straight path within said tubular capsule toward said end wall, means for guiding said tubular capsule along a straight path within said longitudinal passage, forward movement of said inner spacer causing engagement with said earring head and end wall of said tubular capsule to extend said tubular capsule and earring post into said open area to cause said post to pierce said earlobe and engage said earring clutch, and means for limiting retraction of said tubular capsule and for preventing retraction of said post from said earring clutch.

3. The device of claim 2 wherein said means for limiting retraction includes a unidirectional ramp positioned on a peripheral surface of said tubular capsule spaced from said end wall, said ramp tapering downwardly and outwardly toward said end wall permitting outward movement of said tubular capsule to extend from said cartridge passage and having an upward wedged end preventing retraction into said cartridge passage.

4. The device of claim 3 wherein said means for limiting retraction includes:

a pair of covers hinged along opposing diametrical side wall portions of said tubular capsule, said covers including end wall sections folding together over said end wall having said slot to form a complete end wall to enclose said earring post and earring head within said tubular capsule in a retracted position, said covers unfolding into an open position upon extension of said tubular capsule into said open area and limiting retraction of said tubular capsule.

5. The device of claim 4 wherein said means for limiting retraction includes:

a pair of spring arms extending upwardly from opposing diametrical side wall portions of said inner spacer, said inner spacer having a clearance area between said side wall portions, said spring arms being foldable downwardly onto said clearance area and disposed within said tubular capsule in said retracted position, said spring arms unfolding into an upward extending position upon extension of said tubular capsule and inner spacer into said open area and limiting retraction of said tubular capsule and inner spacer.

6. The device of claim 5 wherein said inner spacer includes a longitudinal passage at one end for receiving instrument operating mechanisms.

7. The device of claim 6 wherein said means for guiding said inner spacer within said tubular capsule includes an alignment channel along the upper surface of said inner spacer and a cooperating rib on the inner surface of said tubular capsule.

8. The device of claim 7 wherein said means for guiding said tubular capsule within said cartridge longitudinal passage includes a rib on the upper surface of said tubular capsule and a cooperating raised channel along the cartridge longitudinal passage.

9. The device of claim 8 wherein said cartridge longitudinal passage includes a longitudinal slot in a lower end portion, and said tubular capsule includes a slot in a lower surface, said cartridge and capsule slots being engageable with an instrument operating mechanism.

10. The device of claim 9 wherein said inner spacer includes a flexible ramp and projection in a lower surface engageable with said tubular capsule slot and permitting partial retraction of said spacer within said tubular capsule.

11. The device of claim 2 wherein said cartridge includes extending ears at opposing sides and inner retainers engageable with said instrument.

12. An earlobe piercing device comprising:

a manually operable instrument having a spring biased handle extending outwardly in a rest position, a push rod and a spring cushioned extractor shaft disposed in an upper portion of said handle and movable therewith, an open channel at one end of said instrument, a cartridge receivable in said open channel, said cartridge having a longitudinal passage at one end and a supporting wall at an opposed end, said supporting wall having a retainer channel for holding an earring clutch, said retainer channel being aligned with and spaced from said longitudinal passage, said cartridge including an open area between said one end of said cartridge and said supporting wall for receiving an earlobe and a longitudinal slot in a lower portion of said longitudinal passage, a tubular capsule slidable within said longitudinal passage and having an end wall and side walls extendable into said open area toward said supporting wall from a stationary retracted position, said end wall having a slot for receiving an earring post and supporting an earring head adjacent the inner side of said end wall, a lower wall of said capsule having a longitudinal slot, an inner spacer slidable within said tubular capsule and extendable therewith into said open area, said inner spacer having a longitudinal passage at one end, means for guiding said inner spacer along a straight path within said tubular capsule toward said end wall, means for guiding said tubular capsule along a straight path within said cartridge longitudinal passage, said push rod being receivable within said inner spacer longitudinal passage, and said extractor shaft being engageable with said longitudinal slot in said capsule lower wall, contraction of said handle causing forward movement of said extractor shaft to move said tubular capsule and movement of said push rod within said inner spacer moving said spacer into engagement with said earring head and end wall of said tubular capsule and causing said tubular capsule and earring post to extend into said open area to cause said post to pierce said earlobe and engage said earring clutch, and means for limiting retraction of said tubular capsule and for preventing retraction of said post from said earring clutch.

13. The device of claim 12 wherein said extractor shaft includes an extension passing through said longitudinal slot in said cartridge longitudinal passage and through said longitudinal slot in said lower wall of said capsule.

14. The device of claim 13 including means to release said cartridge from said instrument for disposal following completion of said earlobe piercing.

15. The device of claim 14 wherein said means for limiting retraction includes a unidirectional ramp positioned on a peripheral surface of said tubular capsule spaced from said end wall, said ramp tapering downwardly and outwardly toward said end wall permitting outward movement of said tubular capsule to extend from said cartridge passage and having an upward wedged end preventing retraction into said cartridge passage.

16. The device of claim 15 wherein said means for limiting retraction includes:

a single cover hinged along a side wall portion of said tubular capsule;

said cover including an end wall section folding over said end wall having said slot to form a completed end wall to enclose said earring post and earring head within said tubular capsule in a retracted position;

said cover unfolding into an open position upon extension of said tubular capsule into said open area and limiting rectraction of said tubular capsule;

a single spring arm extending upwardly from a sidewall portion of said inner spacer;

said inner spacer having a clearance area between opposite sidewall portions;

said spring arm being foldable downwardly onto said clearance area and disposed within said tubular capsule on said retracted position;

said spring arm unfolding into an upward extending position upon extension of said tubular capsule and inner spacer into said open area and limiting retraction of said tubular capsule and inner spacer.

17. The device of claim 15 wherein said means for limiting retraction includes:

a pair of covers hinged along opposing diametrical side wall portions of said tubular capsule, said covers including end wall sections folding together over said end wall having said slot to form a complete end wall to enclose said earring post and earring head within said tubular capsule in a retracted position, said covers unfolding into an open position upon extension of said tubular capsule into said open area and limiting retraction of said tubular capsule.

18. The device of claim 17 wherein one of said pairs of covers is wider than the other to overlap said slot in said end wall when folded together to enclose said earring post and to retain and align said earring post.

19. The device of claim 17 wherein said means for limiting retraction includes:

a pair of spring arms extending upwardly from opposing diametrical side wall portions of said inner spacer, said inner spacer having a clearance area between said side wall portions, said spring arms being foldable downwardly onto said clearance area and disposed within said tubular capsule in said retracted position, and said spring arms unfolding into an upward extending position upon extension of said tubular capsule and inner spacer into said open area and limiting retraction of said tubular capsule and inner spacer.

20. The device of claim 19 wherein said means for guiding said inner spacer within said tubular capsule includes an alignment channel along the upper surface of said inner spacer and a cooperating rib on the inner surface of said tubular capsule.

21. The device of claim 20 wherein said means for guiding said tubular capsule within said cartridge longitudinal passage includes a rib on the upper surface of said tubular capsule and a cooperating raised channel along the cartridge longitudinal passage.

22. The device of claim 21 wherein said inner spacer includes a flexible ramp and projection in a lower surface engageable with said tubular capsule slot and permitting partial retraction of said spacer within said tubular capsule.

23. The device of claim 22 wherein said cartridge includes extending ears at opposing sides and inner retainers engageable with said instrument.

* * * * *